US007026729B2

(12) United States Patent
Homan et al.

(10) Patent No.: US 7,026,729 B2
(45) Date of Patent: Apr. 11, 2006

(54) EXHAUST FAN TIMEOUT SYSTEM

(75) Inventors: Timothy C. Homan, 2790 Club Dr., Los Angeles, CA (US) 90064; Richard Faith, Phoenix, AZ (US)

(73) Assignee: Timothy C. Homan, Los Angeles, CA (US)

( * ) Notice: Subject to any disclaimer, the term of this patent is extended or adjusted under 35 U.S.C. 154(b) by 29 days.

(21) Appl. No.: 10/043,014

(22) Filed: Jan. 8, 2002

(65) Prior Publication Data

US 2003/0127914 A1 Jul. 10, 2003

(51) Int. Cl.
*H01H 43/00* (2006.01)

(52) U.S. Cl. ..... 307/141; 307/139; 307/140

(58) Field of Classification Search ..... 307/11, 307/31, 116, 139–141, 112
See application file for complete search history.

(56) References Cited

U.S. PATENT DOCUMENTS

| | | | | |
|---|---|---|---|---|
| 2,157,664 A | | 5/1939 | Hansen | |
| 2,326,957 A | | 8/1943 | Maguire | |
| 3,896,509 A | | 7/1975 | Stipp et al. | |
| 4,280,063 A | * | 7/1981 | Yokomori et al. | 307/141.4 |
| 4,349,748 A | * | 9/1982 | Goldstein et al. | 307/132 E |
| 4,389,599 A | | 6/1983 | Jabor | |
| 4,440,503 A | * | 4/1984 | Arichi et al. | 368/107 |
| 4,642,441 A | | 2/1987 | Kenyon | |
| 4,933,995 A | | 6/1990 | Canon | |
| 4,968,870 A | * | 11/1990 | Moon | 219/222 |
| 5,175,453 A | * | 12/1992 | Chang et al. | 327/276 |
| 5,299,327 A | | 4/1994 | Wilkerson | |
| 5,465,188 A | * | 11/1995 | Pryor et al. | 361/18 |
| 5,473,204 A | | 12/1995 | Temple | |
| 5,745,927 A | * | 5/1998 | Hoareau | 4/213 |
| 5,781,108 A | * | 7/1998 | Jacob et al. | 340/552 |
| 5,947,814 A | | 9/1999 | Czeck et al. | |
| 6,125,642 A | * | 10/2000 | Seener et al. | 62/193 |
| 6,326,882 B1 | * | 12/2001 | Chiu et al. | 340/309.9 |
| 6,549,430 B1 | * | 4/2003 | Hosotani et al. | 363/21.08 |

FOREIGN PATENT DOCUMENTS

JP 56030673 A * 3/1981

OTHER PUBLICATIONS

Paul Horowitz / Winfield Hill, The Art of Electronics 1986, Cambridge, p. 116.*

* cited by examiner

*Primary Examiner*—Robert L. DeBeradinis
(74) *Attorney, Agent, or Firm*—Fulbright & Jaworski L.L.P.

(57) ABSTRACT

A system for activating a load such as an exhaust fan within an enclosed area concurrently with the activation of a lamp switch and for continuing the operation of the load for a predetermined period of time after the deactivation of the lamp switch. A monitor detects when the lamp switch is activated and provides an output signal representative thereof. A timer is provided which is deactivated when the monitor output signal is present but functions when the lamp switch is deactivated and after a preset but variable time provides a signal for deactivating the load. The timer includes a pulse generator and a counter which receives the output of the pulse generator and counts pulses when the lamp switch is deactivated and provides the deactivation signal for the load when it reaches a predetermined count.

9 Claims, 5 Drawing Sheets

EXHAUST FAN TIMEOUT SYSTEM

FIELD OF THE INVENTION

The present invention relates generally to exhaust fans and more particularly to a system which activates the exhaust fan when a light is turned on but causes the exhaust fan to continue to operate after the light is extinguished for a period of time, which time may be varied as desired by the user. The system is particularly adapted for utilization in bathrooms but may also be used for other applications where an exhaust fan is to be operated subsequent to the time individual has left the area which the exhaust fan is intended to clear.

BACKGROUND OF THE INVENTION

For many years, electrically operated fans have been used to ventilate undesirable gases and odors from living quarters of various kinds such as homes, recreational vehicles and residences of various other types. Such fans are particularly useful for rooms such as bathrooms, kitchens, attics, and basements and are used to vent gases and odors to the outside air.

Many different types of venting systems are known such as window mounted fans, door frame mounted fans, roof mounted fans and the like. It is also known that it may be desirable to delay the inactivation of the fan for a period of time after a switch has been turned off. Many types of time delay circuits are available providing for automatic control of the circuit so that lights or fans are turned on or off after a preselected time interval.

Despite the many ventilating systems and time delay switches which are available in the prior art, there is a need for a simple effective timeout exhaust fan system which includes a variable time delay capable of being set by the user and which preferably may be configured for direct replacement of conventional wall mounted switches.

SUMMARY OF THE INVENTION

According to the present invention, there is provided a system for activating a load such as an exhaust fan concurrently with the activation of a lamp switch and for continuing the operation of the load for a predetermined grace period time after the deactivation of the lamp switch. The system includes a monitor for detecting when the lamp switch is activated and for providing an output signal at a first level which is representative thereof. A timer is provided which is deactivated during the time said monitor output signal is at its first level but functions when said lamp switch is deactivated and after a preset but variable time provides a signal for deactivating the load.

According to a more specific aspect of the present invention, the timer includes a pulse generator and a counter with the counter receiving the output signal of the pulse generator. The pulse generator is activated upon receipt of the monitor output signal at the first level indicating activation of the lamp switch but the counter is disabled during that time. The counter is enabled when the lamp switch is deactivated and the monitor output signal level changes responsive thereto causing the counter to count the output of the pulse generator for a predetermined count. The time to reach that count can be varied as desired. Upon the counter reaching the predetermined count it generates an output signal for deactivating the exhaust fan.

DETAILED DESCRIPTION

The present invention is adapted specifically for use within an enclosed area such as a bathroom in which it is desired to control the operation of an exhaust fan where the existing lighting means and the exhaust fan are both designed to operate simultaneously from the same power source. Under these circumstances, it is most desirable that the exhaust fan begin operation when the switch controlling the lighting means is turned on. In accordance with the present invention, the exhaust fan is to continue operation for a user determined time interval after the switch controlling the lighting means is turned off. The system of the present invention is adapted for being packaged in such a manner that it can be readily inserted to replace standard switches presently in use in such enclosed areas and provides the ability for the user to control the amount of time that the exhaust fan continues to operate after the light switch is turned off. Preferably, the system of the present invention is constructed of solid state devices which can be operated at relatively low voltages and will consume a minimal amount of power while effecting the desired operation and control of the exhaust fan.

Figure 1:
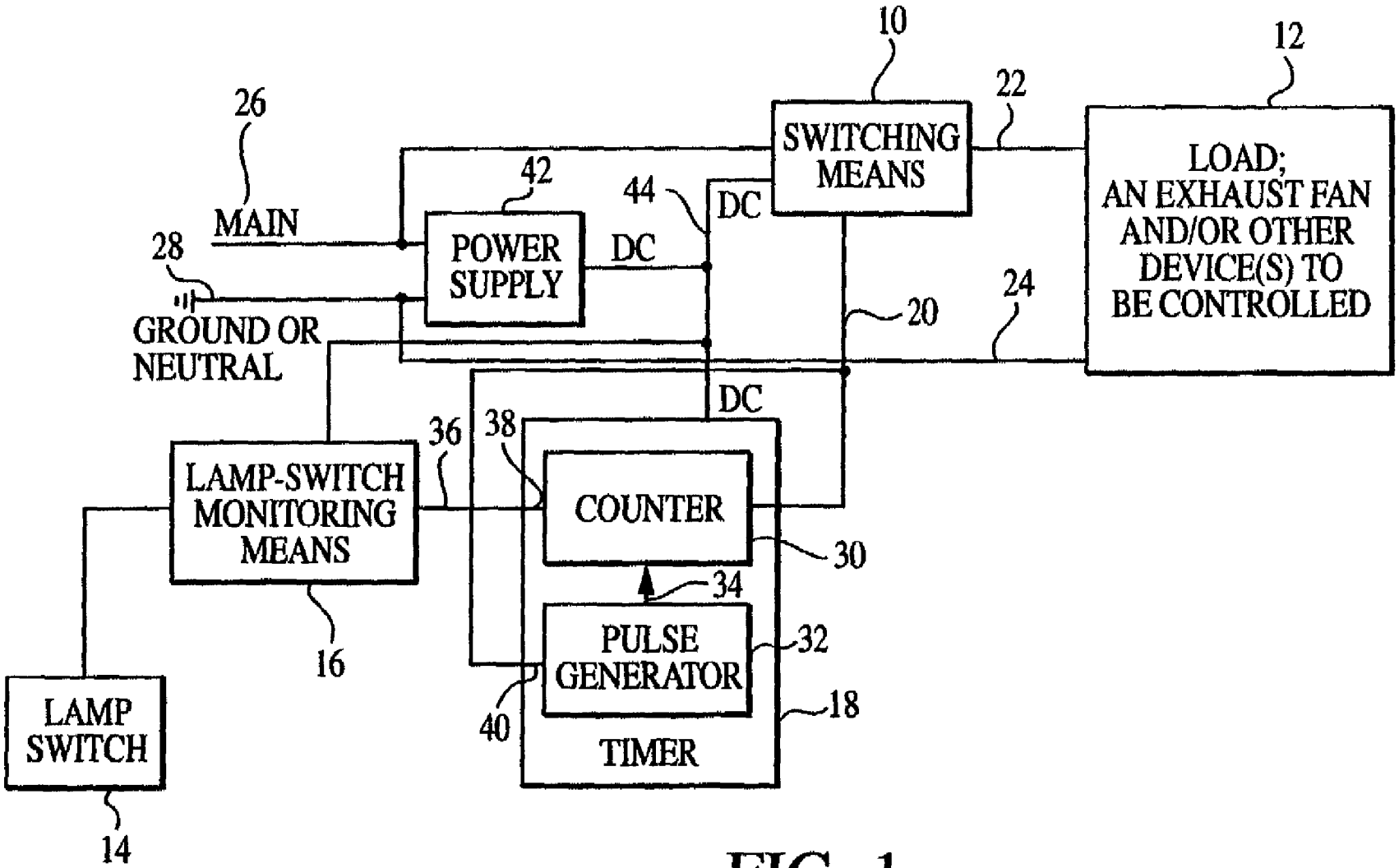
FIG. 1 is a schematic block diagram generally showing the system of the present invention.

Referring now more particularly, to FIG. 1, there is shown a generalized schematic block diagram illustrative of the present invention. As is therein shown, a switching means 10 is utilized to connect electrical energy to a load 12. The switching means is turned on or off to control the operation of the load depending upon the conditions present in the space of concern. As above indicated, typically, the load will commence operation simultaneously with the activation of a light contained within the space. The activation of the light is accomplished by turning a lamp switch 14 on. When the lamp switch 14 is turned on a signal, typically the voltage present at the lamp switch to operate the lamp, is applied as an input signal to a lamp switch monitoring means 16. When the lamp switch monitoring means 16 senses that the lamp switch 14 has been turned on, a signal is provided through the timer 18 over the lead 20 to the switching means 10 to turn the switching means on. When the switching means is on, electrical power is applied by way of the leads 22 and 24 from the main or positive power terminal 26 and the ground or neutral terminal 28 thereof respectively. In accordance with the principles of the present invention, the main power source 26 may be alternating current or direct current depending upon the particular application involved. Such will be more fully discussed hereinafter.

When the lamp switch is turned off to deactivate the lamp source, it is desired that the load 12 continue to function for a predetermined period of time. The amount of time during which the load will continue to operate is ascertained by the timer 18. In accordance with a preferred embodiment of the present invention, the timer 18 includes a counter 30 which is coupled to a pulse generator 32 by the lead 34 to receive the output signal which is nominally a plurality of pulses from the pulse generator to be counted by the counter. Upon the counter, receiving a predetermined count in a time interval determined by the user, a signal is provided from the counter over the lead 20 to deactivate the switching means 10 and open the circuit providing the power to the load 12. However, during the time that the lamp switch is on, it is important to note that it is undesirable for the output of the timer to generate a signal to turn the switching means off. As a result, the counter 30 is deactivated or rendered inoperable during the period of time that the lamp switch is on. This is accomplished by having the lamp switch monitoring means 16 generate a signal at the output 36 thereof which is applied to the reset terminal 38 of the counter 30. At the same time, the output signal from the counter is applied as an input signal to the input terminal 40 of the pulse generator 32. Because the counter is being reset, its output is in a state that causes the pulse generator to commence activity and to provide a continuous series of output pulses which are applied by the lead 34 to the counter 30. However, since the counter 30 has a signal appearing at its reset which causes the counter to be deactivated, the counter does not count the pulses at this point in time.

When the lamp switch is turned off, the output signal from the lamp switch monitoring means present on the lead 36 changes state and removes the reset signal from the terminal 38 and instead applies an activate signal thereto which allows the counter to commence counting. Upon the counter receiving a predetermined number of pulses it will then generate an output signal which is applied over the lead 20 to the switching means 10 to deactivate the switching means 10 and remove power from the load 12. At the same time, the counter output is also applied to the pulse generator over line 40, so as to disable the pulse generator until the counter should again be reset. The period of time required for the counter to achieve the desired count may be varied to provide a shorter or longer time within certain limits as desired by the user.

As is also indicated in FIG. 1, there is provided a power supply 42 which provides appropriate direct current voltage over the bus 44 which provides operating potential for the switching means, the lamp switch monitoring means and the timer to function. Typically, that voltage will be 5 volts and may be divided down as needed for operation of the various solid state devices to be described hereinafter.

Figure 2:
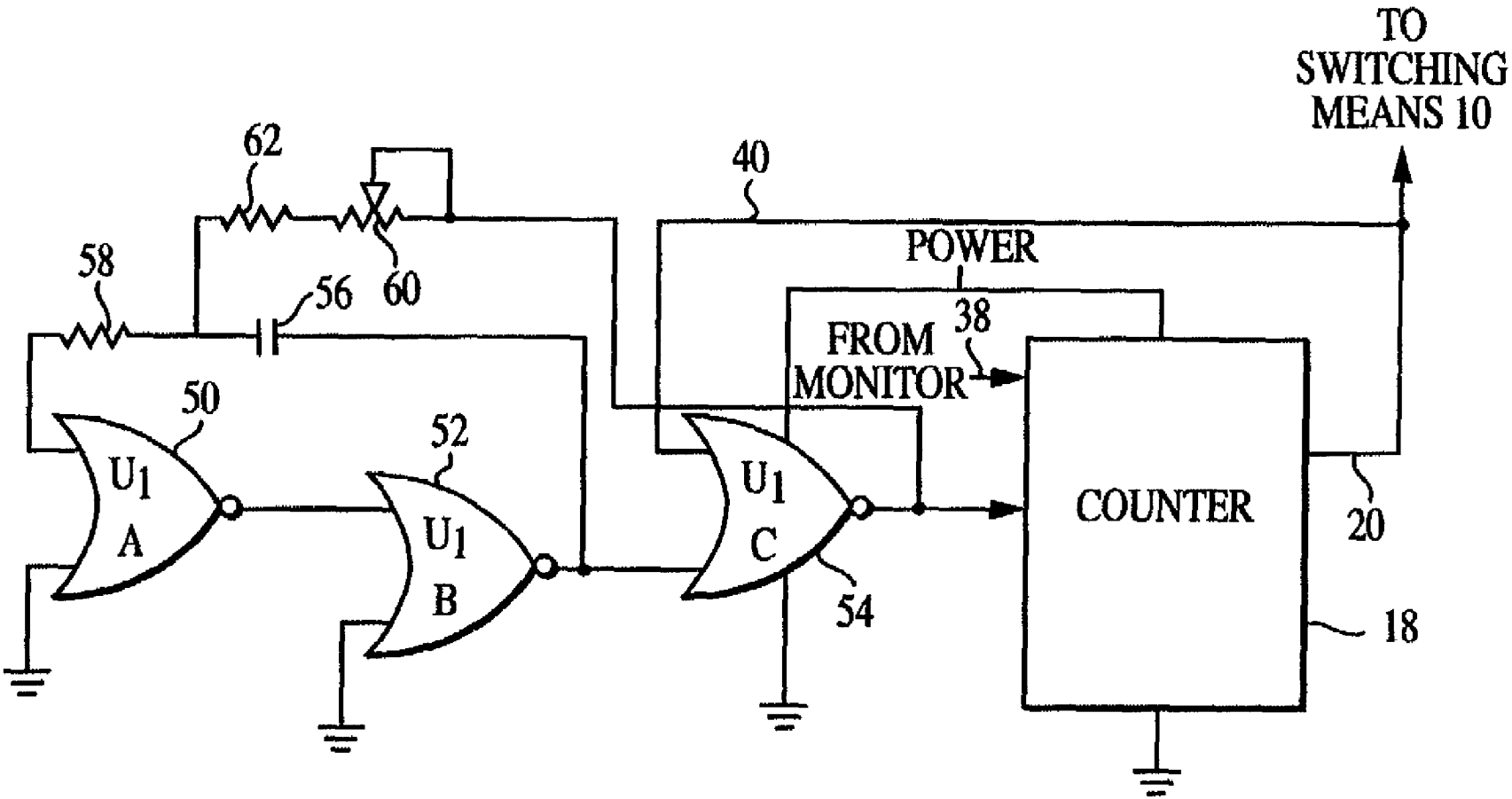
FIG. 2 is a schematic circuit diagram showing the timer of the present invention.

By reference now, more specifically to FIG. 2, there is shown in schematic diagram the timer 18. As is therein shown the pulse generator comprises an oscillator that is in essence the familiar "3-invertor oscillator" with the exception that the output from the counter is connected to the oscillator in such a manner to allow the oscillator to be enabled or disabled depending upon the output signal of the counter. Although an oscillator is shown and described it should be recognized that any pulse generator known to the art maybe used, for example, the well-known free running flip-flop circuit.

As is shown, the oscillator includes NOR gates 50, 52 and 54. The output signal of NOR gate 50 is connected as an input to the NOR gate 52. The output of the NOR gate 52 is connected as an input to the NOR gate 54 and is also connected through the capacitor 56 and the resistor 58 as an input to the NOR gate 50. The output of the NOR gate 54 is connected through the variable resistor 60 and the resistor 62 to the junction between the resistor 58 and the capacitor 56. The frequency of the oscillator may be controlled by the user through the utilization of the variable resistor 60. The output of the NOR gate 54 is applied as an input signal to the counter 18 which is a standard binary ripple counter well known to those skilled in the art. The output signal from the counter 18 as shown at 20 is applied to the switching means 10 as described in conjunction with FIG. 1 and is also connected via line 40 as an input signal to the NOR gate 54. The output signal 20 from the counter 18 causes the oscillator to be enabled or disabled. When the lamp switch 14 is turned on, the logic signal generated by the lamp switch monitoring means 16 goes high and is applied as is shown at 38 as an input to the counter 18. When this signal is high, the binary counter 18 is forced into a reset condition wherein the output signal 20 is low. The low state of the output signal is such that it dictates that the load 12 is to be powered. This low condition output signal 20 being applied as an input signal to NOR gate 54 causes the oscillator to be enabled and to free run at a frequency which has been determined by the position of the potentiometer 60. However, since the counter 18 is in its reset condition as a result of the high output signal from the lamp switch monitoring means 16, it is disabled and is not allowed to count. That is, since the lamp switch is on, the load is to be powered and the switching means is closed to accomplish this. If for some reason the lamp switch is left on indefinitely, the counter 18 will be held indefinitely in a non-counting state with its output signal 20 low.

If, however, the lamp switch is turned off, the lamp switch monitoring means will then deliver a low level logic signal to the input of the counter 30 thus enabling the counter and allowing it to count the oscillator cycles from the output of the NOR gate 54. The counter will continue to count until it reaches the predetermined number of counts and at that time, the output signal at 20 will rise to the high state which will cause the switching means 10 to open and thus, remove power from the load. The predetermined number of counts may be any number preset for the counter. At the same time, this high state signal will be applied as an input to the NOR gate 54 disabling the oscillator. It is necessary to disable the oscillator when the load is to have the power removed from it to prevent the counter from continuing to count. If the oscillator is allowed to continue to run and the counter continues counting, the output signal at the lead 20 would go low again when the counter overflowed causing the switch means 10 to close thus, again applying power to the load when such is not desired.

The timer comprising the oscillator and counter as above described in conjunction with FIG. 2 is commonly used irrespective of the electrical configuration of the overall control circuit. That is, this timer is used for a system which is powered by 120 volt AC, 12 volt negative ground system and 12 volt positive ground system.

Figure 3:
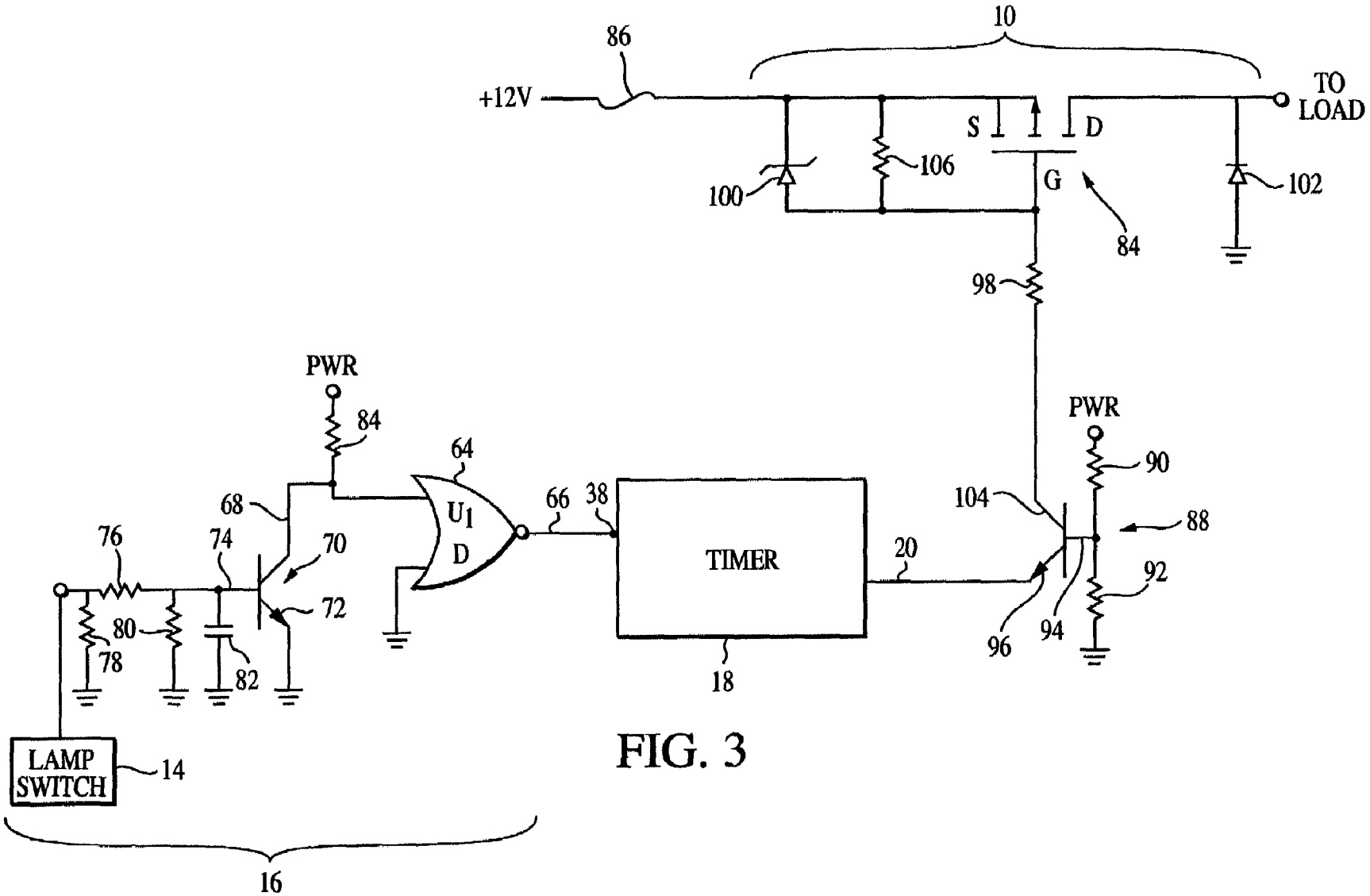
FIG. 3 is a schematic circuit diagram partly in block form showing the system of the present invention powered by a 12 volt DC negative-ground circuit.

By reference now, more particularly, to FIG. 3 there is shown in simplified schematic diagram partly in block form a system constructed in accordance with the present invention which is designed for utilization in a 12 volt negative ground direct current system. As is therein shown, a timer 18 as illustrated in FIG. 2 and above described forms a part of the system. The lamp switch monitoring means 16 includes an inverter-connected NOR gate 64, the output 66 of which is connected to the input 38 of the timer 18 and as above described is the reset signal. Connected as one input to the NOR gate 64 is the collector 68 of the NPN transistor 70, the emitter 72 of which is connected to ground. The base 74 of the transistor 70 is connected through a current limiting resistor 76 to the plus 12 volt signal which comes from the lamp switch when the lamp switch is turned on to activate the lamp (not shown). A pair of resistors 78 and 80 are connected to the base 74 and across the resistor 76 and to ground to assure that the transistor 70 will be completely turned off when the lamp switch is off. The capacitor 82 is used to bypass high frequency signals to ground thereby suppressing electrical noise that might be present when the lamp switch is off and therefore, eliminates the possibility that the system may be inadvertently turned on when such is not desired.

When the lamp switch is off, the voltage appearing at the base 74 of the transistor 70 is zero volts; as a result, there is no conduction through the NPN transistor 70 and it functions effectively as an open circuit. As a result, the voltage connected to the pull up resistor 84 which is connected to power (approximately 5 volts positive) causes the collector 68 and thus the input to the NOR gate 64 to be at a high level logic state. This is in turn inverted by the inverter connected NOR gate ultimately producing a low level logic state at the output 66 thereof. As above described, when such is done, the counter would be enabled: however, since the output of the counter is resting in a high state, the oscillator is disabled and thus, the timer remains inhibited with its output in a high state.

When the lamp switch is turned on, sufficent positive bias is applied via resistor 76 to the base 74 of the transistor 70 to cause it to conduct which brings the collector 68 of the transistor down to a low logic state. That signal being applied as input to the inverter connected NOR gate 64 causes the output 66 thereof to go to a high state which is then applied to the timer 18. The high state of the output of the lamp switch monitoring means is applied as a reset signal to the counter, therefore, disabling the counter. Although, at the same time, the pulse generator 32 commences operating to provide a series of pulses as an input to the counter 30, the generated pulses are not counted because of the reset condition.

The switching means 10 as illustrated in FIG. 3 includes a field effect transistor (FET) which is a typical P-channel MOSFET well known to those skilled in the art. The source S of the FET 84 is connected to the 12 volt power supply through a fuse 86. The drain D of the FET is connected to the output of the switching means which is, in turn, connected to supply the 12 volt power to the load when the FET 84 is conducting. The gate G of the FET 84 is connected through a non-inverting level shifter NPN transistor 88. A voltage divider, including resistors 90 and 92 is connected between a source of power and ground to provide bias to the base 94 of the transistor 88. The emitter 96 is connected to the output of the timer and thus has either the low level or high level signal applied thereto depending upon the position of the lamp switch and the state of the counter at any particular point in time. A Zener diode 100 is connected across the source and gate of the FET 84 and prevents over voltage of the gate which might otherwise occur if voltage surges are present on the incoming main power supply. A diode 102 clamps the inductive kick back (the fly back pulse) that occurs when the FET 84 turns off thereby avoiding drain to source over voltage of the FET 84. A current limiting resistor 98 is connected to the collector 104 of the transistor 88 and is utilized to limit the current through the Zener diode 100 during transient over voltage conditions. Otherwise, the voltage drop across the resistor 98 is insignificant.

When the output of the timer 18 is low, the emitter 96 of the transistor 88 is held near ground potential allowing the voltage divider comprising resistors 90 and 92 to bias transistor 88 into saturated conduction. When such occurs, the collector 104 of the transistor 88 is also near ground potential which pulls the gate G of the FET 84 down to near ground potential. This bias delivered to the gate of FET 84 causes it to conduct heavily, therefore, acting as a closed switch between the plus 12 volt line voltage and the load.

When the output of the timer goes high as above described, the emitter junction of the transistor 88 is reversed biased causing the collector conduction of the transistor 88 to drop to zero thereby effectively causing the transistor 88 to appear as an open circuit. When such occurs, the resistor 106 connected between the gate and source of the FET 84 discharges the gate to source capacitance of the FET 84 causing it to cease conducting thus becoming an open circuit and disconnecting the power source of the load.

Figure 4:
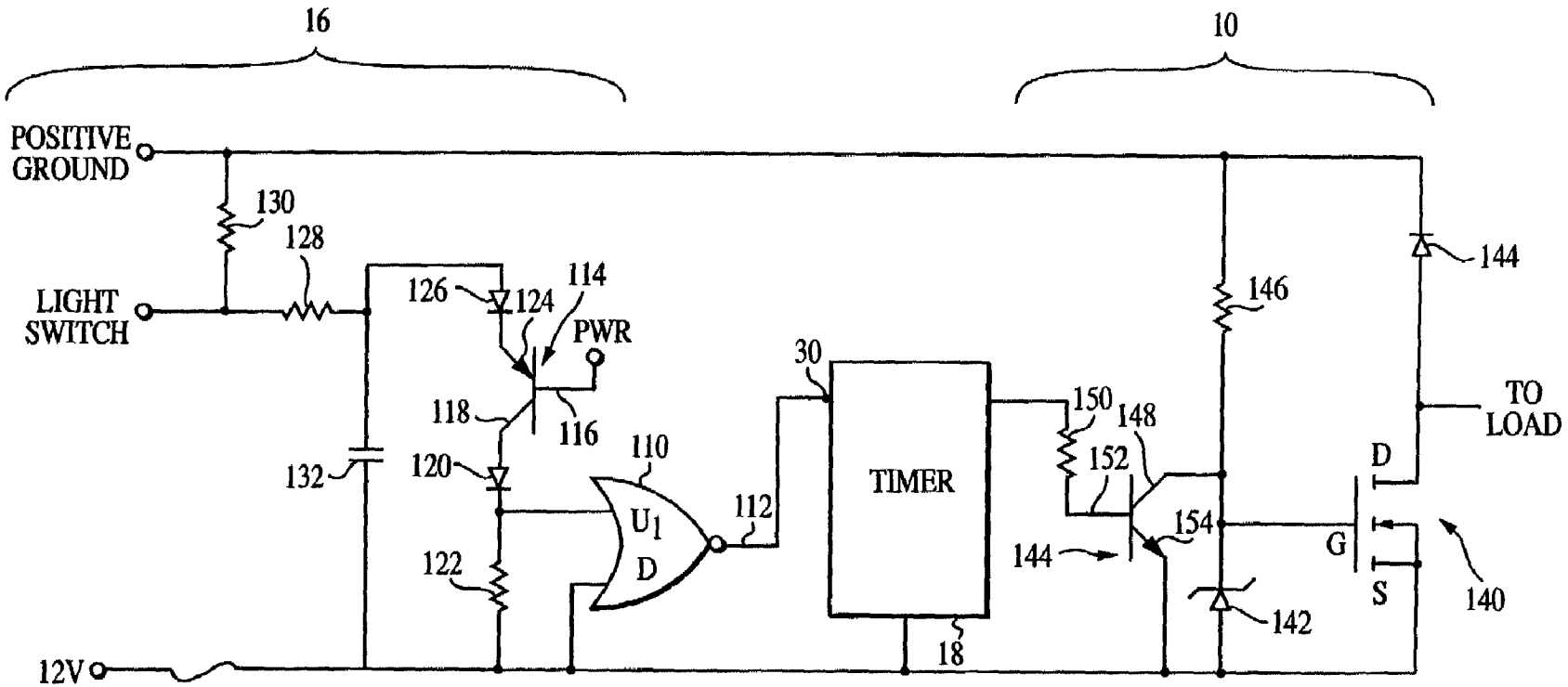
FIG. 4 is a schematic diagram partly in block form of the system similar to that of FIG. 3 but utilizing a 12 volt DC positive ground.

By reference now to FIG. 4, there is illustrated a system similar to that of FIG. 3 but designed to operate on a 12 volt direct current positive-ground system. As is illustrated, the system of FIG. 4 also utilizes the switching means 10, the lamp switch monitoring means 16 and the timer 18. The timer 18 is identical to the timer circuit as is illustrated in FIG. 2 and described above. The lamp switch monitoring means 16 and the switching means 10 are substantially the same as is shown in FIG. 3 but modified to function in a positive-ground system. The lamp switch monitoring means as illustrated in FIG. 4, includes an inverter connected NOR gate 110 the output 112 of which is connected as the input 30 of the timer 18. A PNP transistor 114 has its base 116 connected to the power source of the logic circuits including NOR gate 110 and its collector 118 connected through a diode 120 and a resistor 122 to the minus 12 volt common for this system. The logic power source is typically 5 volts above the potential of the −12 v "hot" wire. The emitter 124 of the transistor 114 is connected through a diode 126 and resistors 128 and 130 to the positive ground. A noise suppressing capacitor 132 is connected between the positive ground and the minus 12 volt common to suppress electrical noise which might be present on the system whenever the lamp switch is off.

The operation of the monitoring means in the positive ground configuration is probably the most confusing because in this model the internal ground of the logic level components is actually connected to the "hotwire" of the external electrical system. When the lamp switch is off, the lamp itself would normally provide a low-resistance path from the positive ground of the electrical system to its connection to the lamp switch and the lamp switch input terminal of the timer 18. However, in the event the lamp is burned out, that path will not exist and the timer unit would effectively see this condition as an on condition in the lamp switch, consequently causing power to be applied to the load and in the case of an exhaust fan, to have it run indefinitely. To prevent this occurrence, the resistor 130 assures that the lamp switch as "seen" by the monitoring circuit will appear as off whenever it is off even if the lamp is defective.

The operation of the circuit as shown in FIG. 4 is best understood by referencing all voltage levels to the timer circuit internal "ground or common which is the −12 volt bus". Thus, the minus 12 volts is reckoned as zero volts, positive ground is reckoned as plus 12 volts, lamp switch input is reckoned as plus 12 volts for the "off" condition and zero volts for the "on" condition. Accordingly, when the lamp switch is off, plus 12 volts DC is applied through the resistor 128 and diode 126 to the emitter 124 of the PNP transistor 114. The plus 12 volts minus the forward drop of the diode 126 minus the forward drop of the transistor 114 emitter-base diode substantially exceeds the voltage on the base 116 of the transistor 114 (nominally about plus 5 volts).

As a result, transistor 114 conducts in a saturated mode with both its emitter and collector near plus 5.6 volts. Diode 120 drops about 0.6 volts so that the NOR gate 110 input will not be pulled above the approximately plus 5 volt power that the NOR gate is running on. This is a safeguard against misoperation of the NOR gate 110. With NOR gate 110 input thus pulled high by the transistor 114 conduction the NOR gate produces a low state output for the monitoring means circuit as a whole. This causes the timer 18 to function in the same manner as above described with reference to FIG. 3.

On the other hand, when the lamp switch is on, the lamp switch input to the timer circuit is at zero volts DC, again relative to the timer circuit common so that transistor 114 is not biased into conduction. This condition allows pull down resistor 122 to pull the input to the NOR gate 110 down to a low logic level resulting in a high logic level output therefrom which again, is applied as the input signal to the input terminal 30 of the timer 18. In this condition, the diode 126 prevents reverse (Zener-mode) conduction in the emitter-base junction of the transistor 114. As above indicated, the capacitor 132 bypasses high frequency signals which might exist on the lamp switch line when the lamp switch is off due to electrical noise thereby avoiding system misoperation.

The switching means 10 in the system as shown in FIG. 4 includes an N-channel MOSFET 140 having the Gate G, Drain D and Source S as shown. The drain is connected to the load as is illustrated. A Zener diode 142 is connected between the gate and the nominal minus 12 volt common of the system. Zener diode 142 protects the gate of the FET 140 against over voltage and does not conduct at all during normal operating conditions. The NPN transistor 148 is provided as a logic inverter because the output logic levels of the timing means are opposite to the states required for the desired switching behavior in the FET 140. An additional advantage of using a discrete transistor as the logic inverter is that the available high-state gate drive for MOSFET 140 is not limited to logic-supply voltage. The diode 144 clamps any flyback voltage that may occur during the FET 140 turnoff thus, preventing damage to the FET 140. Pullup resistor 146 is connected between positive ground and the collector 148 of the transistor 144. The current limiting resistor 150 is connected to the base 152 of the transistor 144 while the emitter 154 thereof is connected to the common minus 12 volt reference for the system.

As will be understood by those skilled in the art, when the output signal from the timer 18 is low, the transistor 144 is cut off allowing the pull up resistor 146 to apply the plus 12 volt to the gate of the FET 140 thus biasing it into hard conduction and applying electrical power to the load. When, however, the timing means output goes high, approximately plus 5 volts is applied through the resistor 150 to the base 152 of the transistor 144 causing the transistor 144 to conduct in a saturated condition thus, bringing the collector 148 low and robbing the gate of the FET 140 of gate bias. This then, in turn, causes FET 140 to cease conduction and effectively to function as an open circuit thereby removing power from the load and causing the fan to cease its operation.

Figure 5:
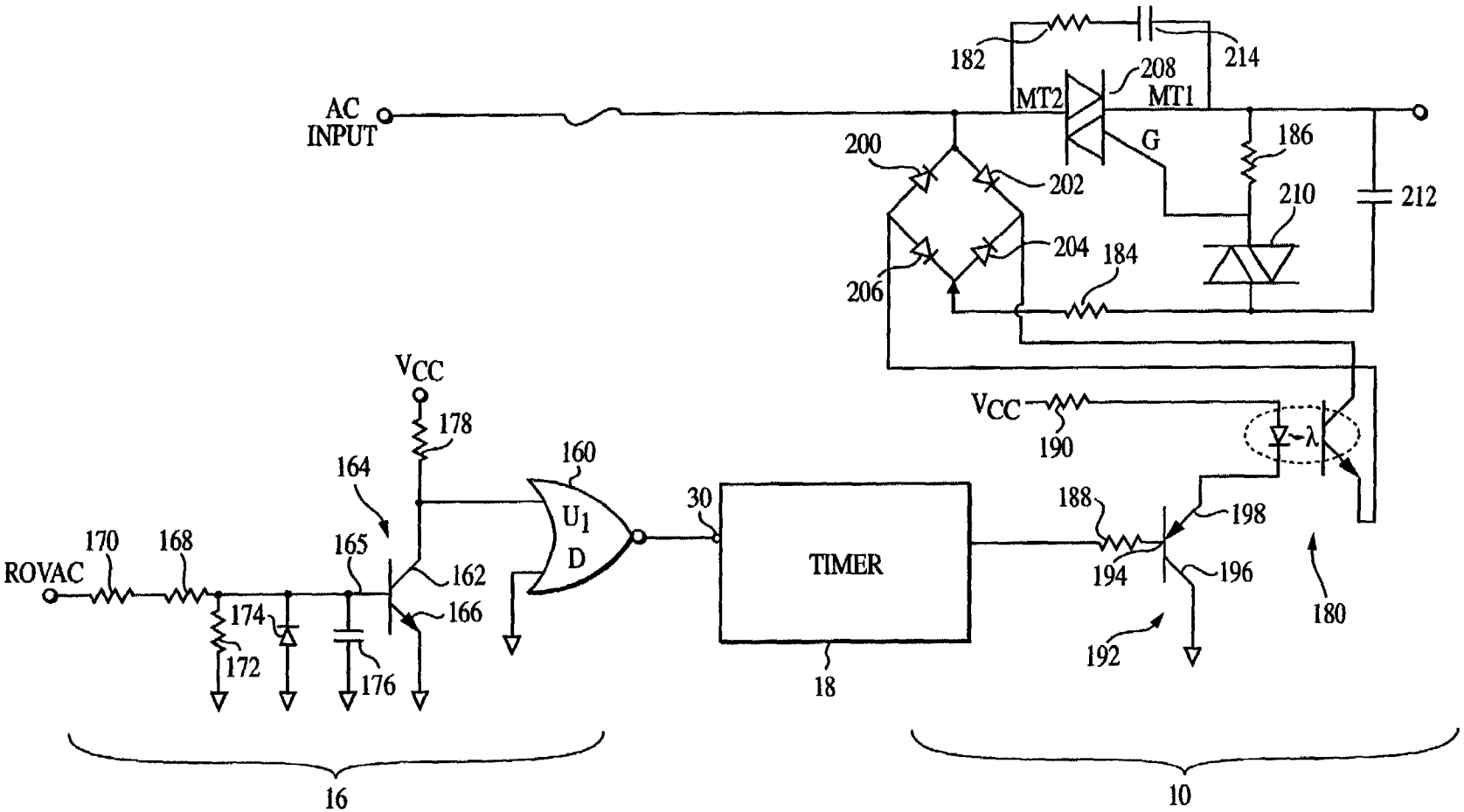
FIG. 5 is a schematic circuit diagram partly in block form of a system in accordance with the present invention which is powered by 120 volt alternating current.

Referring now more particularly to FIG. 5 there is illustrated a system constructed in accordance with the present invention and designed to work on 120 volt alternating current 60 hertz power. As is seen, the system also includes the switching means 10, the lamp switch monitoring means 16 and the timer 18 as above described.

As is illustrated, the lamp switch monitoring means includes an inverter connected NOR gate 160, the output of which is connected as an input to the timer 18 as shown at 30. The input thereof is connected to the collector 162 of the NPN transistor 164, the emitter 166 of which is connected to neutral, the base 165 of the transistor 164 is connected through a pair of resistors 168 and 170 to the 120 volt AC signal which would be present at the lamp switch when the lamp switch has been turned on. The resistors 168 and 170 along with the resistor 172 which is connected to neutral function as a voltage divider reducing the alternating current line voltage to a voltage that is safe for the following circuit. The diode 174 functions to clip the negative half going cycle of the divided down line voltage. The capacitor 176 functions to help prevent electrical noise that may be present on the lamp switch line while the lamp switch is off causing undesirable misoperation of the circuit. An additional function of the resistor 172 is to assure a bias for the base 165 of the transistor 164 of approximately zero volts in the event that the lamp switch is off and the lamp is open. The divided-down line voltage (when the lamp switch is on) is applied to the base 165 of the transistor 164. The positive half cycles of the line voltage cause the transistor 164 to conduct thereby generating pulses of collector conduction. During these pulses, the collector 162 provides a low logic state. During the intervening negative half cycles which have been clipped by the diode 174, the pull up resistor 178 assures that the collector 162 is high since it is connected to the supply voltage the Vcc.

The operation of the monitor circuit is such that in the absence of an alternating current signal from the lamp switch, that is when the lamp is off, the lamp switch monitoring means 16 output connected to the timer 18 is a steady low level logic signal. However, in the presence of an AC signal from the lamp switch, that is when the lamp is on, the output from the lamp switch monitoring means is a line frequency positive half wave pulse wave form. In this respect, the lamp switch monitoring means for the 120 volt AC system differs from the two direct current operated models which provide a steady high level logic signal as long as the lamp switch remains on. This, however, has no ill effect upon the system operation because the timer 18 responds to the 60 hertz pulsed reset signal in substantially the same way that it would respond to a steady DC high reset signal.

Referring now to the switching means 10 it must be recognized that since the operating voltage available for the 120 volt AC system is relatively high compared to the DC operating systems, the logic circuit must be isolated from the main terminal of the system. As a result, an optocoupler 180 is utilized for that purpose. The switching means in the 120 volt system comprises resistors 182, 184, 186, 188 and 190. Also included is a PNP transistor 192 having a base 194 which is connected through the resistor 188 to the output of the timer 18, a collector 196 which is connected to the neutral or common and an emitter 198 which is connected to the optocoupler 180. Diodes 200 through 206 are connected as a full wave bridge rectifier. There is also provided an Triac 208, a Diac 210 and capacitors 212 and 214.

In operation, the output voltage from the timer 18 drives the base 194 of the transistor 192 through the resistor 188. When the timer 18 output is low (that is, the state that should cause the load to have power applied to it) transistor 192 is biased into conduction causing conduction in the LED portion of optocoupler 180 by way of the resistor 190 which is connected to Vcc. In turn, the photo-darlington photo transistor portion of optocoupler 180 conducts thus, behaving as a short circuit across the DC output of the bridge rectifier comprised of diodes of 200 through 206. When Triac 208 is not conducting and there exists a sufficient differential voltage across its main terminals, MT1 and MT2 the short across the diode bridge allows a flow of current through resistor 184, in turn, charging capacitor 212 in the same polarity as the available voltage. Thus, the waveform across the capacitor 212 is alternating current. However, the voltage waveform across capacitor 212 is far from being sinusoidal because any time the absolute value of the voltage across capacitor 212 exceeds the breakover voltage of Diac 210, Diac 210 fires abruptly discharging capacitor 212 into the gate of Triac 208 initiating conduction in Triac 208 across MT1 and MT2. This MT1, MT2 conduction will continue as long as the current waveform through Triac 208 does not cross zero (which will actually happen two times through each AC cycle). Thus, as long as the logic output from the timing means is low, Triac 208 will be held in a conducting state throughout most of the AC cycle so that power is delivered to the load. On the other hand, whenever the timer output is in the high logic state, there is no current through the LED portion of the octocoupler 180 so the photo transistor portion thereof does not conduct leaving the bridge rectifier unloaded. When this occurs, the bridge rectifier appears as an open switch in series with resistor 184 so that the capacitor 212 never charges, Diac 210 never fires, and Triac 208 never fires, leaving the load unpowered. Resistor 186 assists triac 208 to turn off properly. Resistor 182 and capacitor 214 function as a snubber circuit to help prevent inductive load turn off voltage spikes from retriggering Triac 208. The purpose of resistor 188 is to prevent the transistor 192 from going into high frequency oscillations while it is conducting.

There has thus been disclosed an exhaust fan time out circuit which is constructed of solid state devices, is relatively inexpensive, operates at relatively low voltages and can be constructed in such a manner as to be used to retrofit present wall switches. The system allows an exhaust fan to be activated when a light switch is turned on and to remain on for a specified period of time subsequent to the light switch being turned off, the time being variable according to the desires of the users.

What is claimed is:

1. A load activation and variable grace period timing system for use with an exhaust fan comprising:

an exhaust fan;

a monitor for detecting when a lamp switch is activated and providing an output signal at a first level representative thereof;

a timer comprising a pulse generator and a counter, said pulse generator being an analog oscillator including means for varying the frequency thereof, said frequency changes determining the variable grace period, said counter receiving the output of said pulse generator, said timer receiving said output signal of said monitor to activate said pulse generator but to disable said counter so long as said first level output signal is applied, said counter being enabled when said lamp switch is deactivated and said monitor output signal level changes to a second level so that said counter counts said pulse generator output for a predetermined preset but variable time; and a power switch for applying electrical power to said load including said exhaust for when said monitor output signal is at said first level and continuing until said counter reaches said predetermined count.

2. A system as defined in claim 1 wherein the system further includes a direct current power supply and said power switch comprises a field effect transistor.

3. A system as defined in claim 2 which further includes means for coupling said timer to said power switch for deactivating said power switch when said counter reaches said predetermined time of counting.

4. A system as defined in claims 3 wherein said counter generates a signal having one logic level when said lamp switch is activated and a second logic level when said counter reaches said predetermined time of counting.

5. A system as defined in claim 4 wherein means for coupling includes a transistor which conducts in saturation when said signal is at said one logic level to cause said field effect transistor to conduct and which is biased to its non-conducting state when said signal is at its second logic level to cause said field effect transistor to cease conducting.

6. A system as defined in claim 1 wherein the system further includes an alternating current power supply and said power switch comprises a Triac.

7. A system as defined in claim 6 which further includes an optocoupler for coupling said timer to said power switch for deactivating said power switch when said counter reaches said predetermined time of counting.

8. A system as defined in claim 7 wherein said counter generates a signal having one logic level when said lamp switch is activated and a second logic level when said counter reaches said predetermined time of counting.

9. A load activation and grace period timing system comprising:

a monitor for detecting when a lamp switch is activated and providing an output signal at a first level representative thereof;

a timer comprising a pulse generator and a counter, said counter receiving the output of said pulse generator, said timer receiving said output signal of said monitor to activate said pulse generator but to disable said timer so long as said first output signal is applied, said counter being enabled when said lamp switch is deactivated and said monitor output signal level changes to a second level, said counter counts said pulse generator output for a predetermined present but variable time, said counter generates a signal having one logic level when said lamp switch is activated and a second logic level when said counter reaches said predetermined time of counting, said pulse generator including an analog oscillator including means for varying the frequency thereof, said frequency changes determining the variable grace period;

an alternating current power supply;

a Triac power switch for applying electrical power to said load when said monitor output signal is at said first level and continuing until said counter reaches said predetermined preset time; and means for coupling said timer to said power switch including an optocoupler and a transistor which conducts when said signal is at said one logic level to cause said optocoupler to conduct and generate a firing sequence of said Triac and which is biased to its non-conducting states when said signal is at its second logic level to cause said optocoupler to cease conducting and prevent said Triac from firing.

* * * * *